United States Patent [19]

Dötzer et al.

[11] 4,053,383

[45] Oct. 11, 1977

[54] APPARATUS FOR ELECTRODEPOSITING ALUMINUM

[75] Inventors: Richard Dötzer; Klaus Stöger, both of Nuremberg; Josef Stadter, Erlangen, all of Germany

[73] Assignee: Siemens Aktiengesellschaft, Berlin & Munich, Germany

[21] Appl. No.: 713,983

[22] Filed: Aug. 12, 1976

[30] Foreign Application Priority Data

Aug. 21, 1975 Germany ..... 2537256

[51] Int. Cl.[2] ..... C25D 17/06; C25D 17/18

[52] U.S. Cl. ..... 204/225; 204/226; 204/245

[58] Field of Search ..... 204/225, 226, 245, 246, 204/247, 14 N, 39, 64 R

[56] References Cited

U.S. PATENT DOCUMENTS

| | | | |
|---|---|---|---|
| 1,838,666 | 12/1931 | Fink et al. | 204/225 |
| 2,760,930 | 8/1956 | Alpert et al. | 204/226 |
| 2,897,129 | 7/1959 | Dilling | 204/225 |

*Primary Examiner*—T. M. Tufariello

*Attorney, Agent, or Firm*—Kenyon & Kenyon, Reilly, Carr & Chapin

[57] ABSTRACT

Apparatus for electrodepositing aluminum in which an electroplating trough, which contains aprotic oxygen-free and water-free organo-aluminum electrolyte, is closed off in an airtight manner and is accessible only via a lock chamber disposed thereabove and which uses, for inserting and removing the work pieces, a detachable coupling rod carrying a frame with the articles to be electroplated permitting a strongly adhering aluminum layer to be deposited onto work pieces of any design desired with the exclusion of air.

12 Claims, 2 Drawing Figures

APPARATUS FOR ELECTRODEPOSITING ALUMINUM

BACKGROUND OF THE INVENTION

This invention relates to apparatus for electrodepositing aluminum from aprotic, oxygen-free and water-free organo-aluminum electrolytes in general and more particularly to improved apparatus of this nature.

Aluminum electrodeposited from aprotic, oxygen-free and water-free organo-aluminum electrolytes has been found highly suitable for many engineering purposes because of its ductility, freedom from pores, corrosion resistance and ability to be anodized. Such electrolytes, which are known, for instance, from U.S. Pat. Nos. 3,448,127 and 3,418,216 and British Pat. No. 1,001,482, are prepared and stored under oxygen-free and water-free conditions. Since the access of air causes a considerable reduction of the conductivity and the life of these electrolytes because the electrolyte reacts with the oxygen and the moisture of the air, the electrolyte bath must be protected from contact with air as thoroughly as possible. Attempts to carry out the electrodeposition of aluminum in known electroplating apparatus and to accomplish the exclusion of air by covering the electrolytic bath with protective liquids such as paraffin oil or inert gases such as nitrogen, however, have not led to satisfactory results. Such coverings do not provide a reliable protection of the electrolytic bath, since they are repeatedly torn open when the articles to be electroplated are inserted and removed as well as when the electrolyte and/or the articles move. Such operations thus permit air to come into contact with the electrolyte. In addition, the use of an inert gas for protection is not possible since inert gasses mix very easily with the ambient air, so that a closed inert gas layer would not provide reliable air exclusion either.

SUMMARY OF THE INVENTION

It is therefore an object of the present invention to provide apparatus for electrodepositing aluminum in which the electrolyte can be kept under oxygen-free and water-free conditions to thereby obtain an acceptable, useful life for electroplating applications.

According to the present invention, apparatus of the general type mentioned above is provided which includes: an electroplating tank or trough containing the electrolyte; a contact making and holding device arranged inside the electroplating tank; a lock chamber which is disposed above the electroplating tank, is connected with the latter via a closable flap, and has a closable lock opening for inserting and removing the work pieces to be electroplated; an inert gas flooding system in the lock chamber; and a coupling rod in the lock chamber arranged to be lowered into the electroplating trough, for receiving, transferring to the contact making and holding device, and inserting a work piece holder.

In the apparatus according to the present invention, the electrolyte can be reliably protected from contact with air at any point in time of the electroplating process. This is achieved by the provision that inert gas is admitted to the electrolyte in the hermetically sealed electroplating tank and that the flap which connects the electroplating tank with the lock chamber, is opened only when the lock opening is closed and the lock chamber is flooded with inert gas.

In one preferred embodiment of the apparatus, horizontally movable contact making and holding device is provided. This makes a movement of the cathode possible, whereby the work pieces to be electroplated can be moved back and forth during the electroplating process and can be covered with aluminum uniformly and quickly even at higher current densities.

In another preferred embodiment, a rotatable contact making and holding device with at least two support arms is provided. Work pieces suspended from the support arms in the work piece holders can be moved through the electrolyte with a circular revolving path and can thus also be covered with aluminum at higher current densities. In addition, the different support arms can be supplied with current separately, so that different deposition conditions can be set for different work pieces.

A spraying device for spraying a rinsing liquid is preferably provided in the lock chamber. If necessary, the work pieces to be electroplated can also be subjected to a surface pretreatment in the lock chamber. The spraying device, however, is primarily provided for the purpose of washing the completely electroplated work pieces clean of adhering electrolyte before they are removed from the lock chamber.

It is advantageous to provide a reflux cooler in the upper portion of the electroplating tank. In the reflux cooler, solvent vapors rising from the electrolyte are reliquified and returned into the electroplating tank. The solvent losses can thereby be kept extremely low.

Preferably, a relief line, which leads via the reflux cooler and the end of which is immersed in an inert sealing liquid, is connected to the electroplating tank. The relief line provides pressure relief for the electroplating tank while the sealing liquid reliably prevents the access of air.

DETAILED DESCRIPTION OF THE PREFERRED EMBODIMENT

Figure 1:
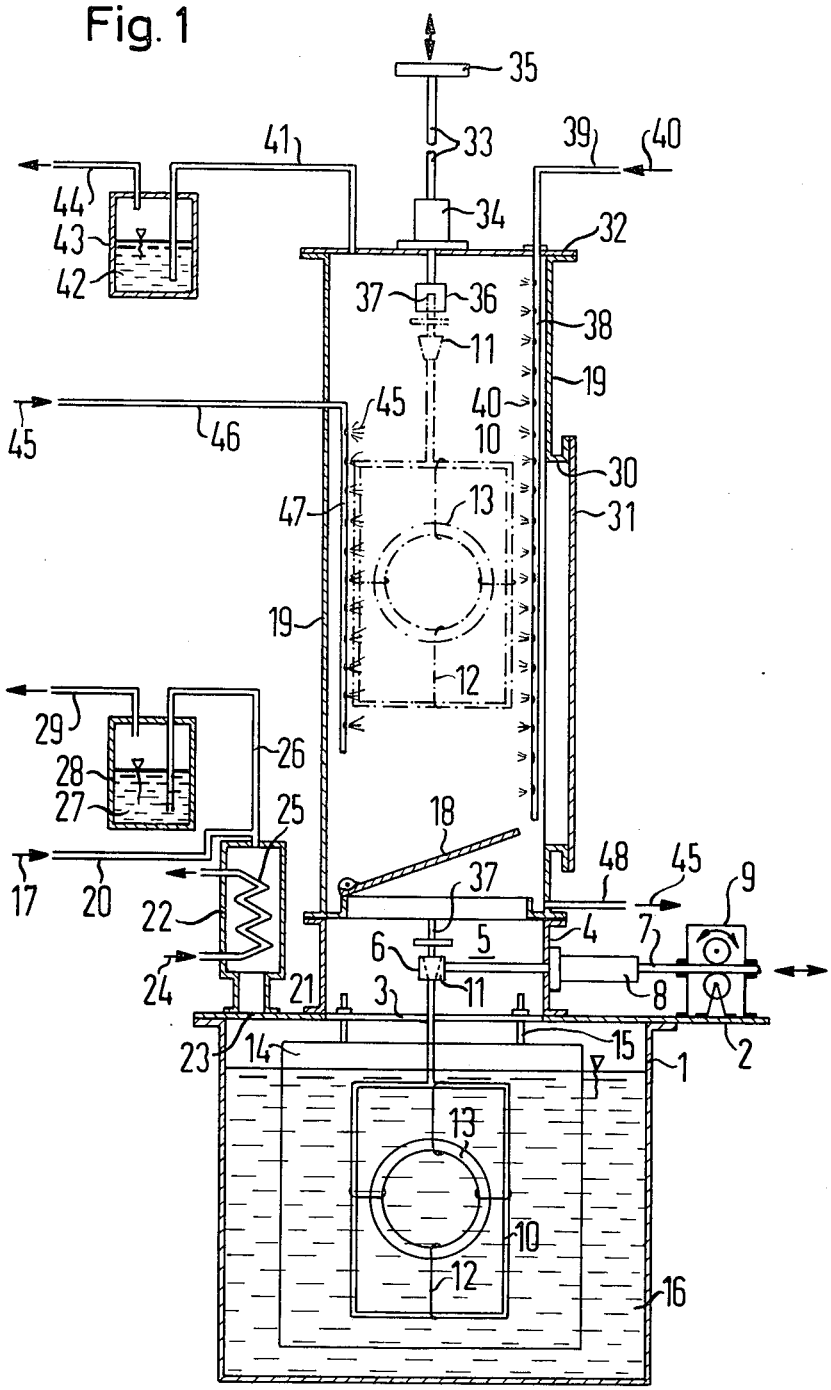
FIG. 1 is a cross sectional view of a first embodiment of the present invention for electrodepositing aluminum having a contact making and holding device which is movable back and forth horizontally.

FIG. 1 illustrates an electroplating tank or trough 1 with a cover 2 consisting, for instance, of enameled sheet steel. The interior of tank 1 extends via an opening 3 in the cover 2 into an antechamber 4. The total tank volume is thus increased by the volume of the antechamber 4. A contact making and holding device 5 is arranged in antechamber 4. Device 5 consists of a receiver 6 of fork shaped design and a cathode rod 7. The horizontally movable cathode rod 7 is brought through the wall of the antechamber 4 via a stuffing gland 8 and is connected to a drive 9, not further detailed. Into the receiver 6 of the contact making and holding device 5, a work piece holder 10 is hung by means of a cone 11. In the work piece holder 10, a ring shaped work piece 13 is fastened by means of holding wires 12. Plate anodes 14, which consist, for instance, of refined aluminum, are hung from holding rods 15 on both sides of the work piece holder 10. The holding rods 15, which are insulated as they are brought through the cover 2, at the same time serve as anode connections. The current is supplied to the work piece 13 via the cathode bar 7 of the contact making and holding device 5, the work piece holder 10 and the holding wires 12.

The electroplating trough 1 contains an aprotic, oxygen-free and water-free organo-aluminum electrolyte 16, which must not come in contact with air. For this reason, an inert gas 17 is admitted to the electrolyte 16 and the interior of the electroplating trough 1, extended by the antechamber 4, is closed off in an airtight manner by the flap 18 of a lock chamber 19 mounted on the antechamber 4. The inert gas 17 is supplied via a line 20, the connecting stub 21 of a reflux cooler 22 and an opening 23 in the cover 2. Solvent vapors rising from the electrolyte condense at the cooling coil 25 of the reflux cooler 22, through which a coolant 24 flows, so that the condensate returns to the electroplating trough 1. For removing excess inert gas 17 and for pressure relief for the electroplating trough 1, an equalization line 26, the end of which is immersed in an inert sealing liquid 27, is connected to the reflux cooler 22. The sealing liquid 27 is contained in a vessel 28, which is designed like a wash bottle and has an outlet 29.

The lock chamber 19 has a laterally arranged lock opening 30, which is provided for inserting and removing the work piece holder 10 and which can be sealed airtight by a door 31. The upper closure of the lock chamber 19 is formed by a lock cover 32, through which a coupling rod 33 is brought. A stuffing gland 34 is provided for sealing the feedthrough. The upper end of the coupling rod 33, which is movable in the vertical direction, is formed by a handle 35 and the lower part, by a coupling part 36. Instead of the handle 35, a pneumatic cylinder can also be used for moving the coupling rod 33. A coupling part 37 of the work piece holder 10 can be coupled to the coupling part 36 so that the work piece holder 10 is in the position shown in dash-dotted lines. From this position, the work piece holder 10 can be lowered through the open flap 18 into the electroplating trough 1 and be hung so that its cone 11 is placed on the fork of the receiver 6 of the contact making and holding device 5. Thereupon, the coupling part 36 is disengaged, the coupling rod 33 withdrawn and the flap 18 closed. The work piece holder 10 is removed from the electroplating trough 1 in the reverse order. The two coupling parts 36 and 37 are designed so that they can be engaged or disengaged from the outside. This can be done, for instance, by switching on or off an electromagnet which is accommodated in the coupling part 36.

The air that enters the lock chamber 19 after each opening of the door 31 is displaced again by means of an inert gas flooding system. The latter consists of a nozzle assembly 38, which is supplied with inert gas 40 via a feed line 39. The excess inert gas 40 and the displaced air are exhausted through a relief line 41 which opens into the lock cover 32 and the end of which is immersed in an inert sealing liquid 42. The sealing liquid is contained in a vessel 43 which is designed like a wash bottle and has an outlet 44.

In addition, a spraying system for spraying a rinsing liquid 45 is arranged in the lock chamber 19. The spraying system consists of a feed line 46, which is brought through the wall of the lock chamber 19 and is connected to a nozzle assembly 47, and of a discharge or drain line 48. The rinsing liquid 45 discharged via the discharge line 48 can be collected in a plenum and returned via suitable conduit means to the feed line 46 to form a closed loop. Suitable rinsing liquids are, for instance, aromatic hydrocarbons such as toluol or xylol.

The supply for the inert gasses 17 and 40 can be connected together. Suitable inert gases are, for instance, nitrogen, helium, argon, krypton and gaseous hydrocarbons.

The sealing fluids 27 and 42 are used to prevent air from reaching the electroplating trough 1 and the lock chamber 19. Suitable sealing liquids are, for instance, paraffin oil or silicon oil.

Before the work pieces to be electroplated are placed in the apparatus described, they must be subjected to a pretreatment as described, for instance, in the U.S. patent application Ser. No. 419,233 filed Nov. 27, 1973 and assigned to the same assignee as the present invention. The subsequent aluminum plating of a work piece 13 includes the following steps:

a. The work piece holder 10 with work piece 13 is coupled to the coupling rod 33,
b. the lock opening 30 is closed by the door 31,
c. the lock chamber 19 is flooded with inert gas 40,
d. the flap 18 is opened,
e. the work peice holder 10 is hung onto the contact making and holding device 5 by lowering the coupling rod 33,
f. the coupling rod 33 is disengaged and withdrawn,
g. the flap 18 is closed,
h. the work piece 13 is electroplated with aluminum while the contact making and holding device 5 is moved back and forth,
i. the flap 18 is opened,
j. the coupling rod 33 is brought down and coupled to the work piece holder 10,
k. the coupling rod 33 is brought up with the work piece holder,
l. the flap 18 is closed,
m. the work piece 13 is sprayed with rinsing liquid 45,
n. the door 31 is opened and the work piece holder 10 is removed from the lock chamber 19.

Figure 2:
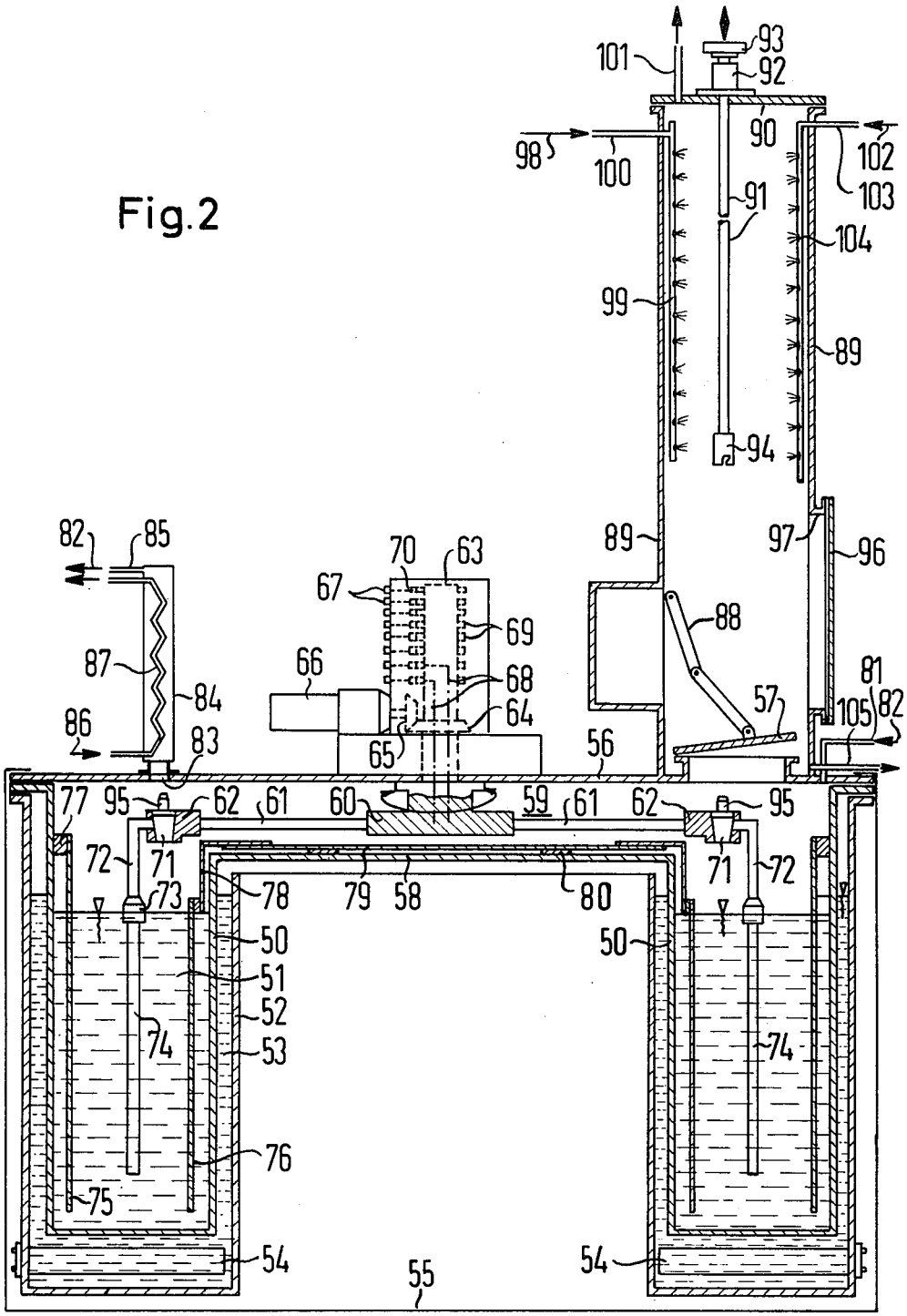
FIG. 2 is a cross sectional view of a second embodiment of the present invention for electrodepositing aluminum having a rotatable contact making and holding device.

FIG. 2 shows a treatment tank 50 of annular design, which contains an aprotic, oxygen-free and water-free organo-aluminum electrolyte 51. Tank 50 hangs in a heating tank 52 likewise of annular design. The heating tank 52 contains a heating bath 53, which can be heated by heater cartridges 54. A jacket placed around the heating tank 52 is indicated by the line 55. The treatment tank 50 is sealed by a circular outer cover 56, which rests on the outer wall and has a built in flap 57, and a circular inner cover 58 permanently connected to the inner wall. The height of the outer wall of the electroplating tank 50 exceeds that of the inner wall so that a contact making and holding device 59 can be accommodated between the outer cover 56 and the inner cover 58. This contact making and holding device 59 consists of a rotor 60 which has eight support arms 61 with receivers 62 attached at uniform spacings. The rotor 60 has a shaft 63 driven by a motor 66 via miter gears 64 and 65. Each of the eight support arms 61 has a separate cathode terminal 67, connections thereto being established via lines 68, slip rings 69 attached to the rotor shaft 63 and brushes 70 shown in dash-dotted lines. Cones 71 of intermediate carriers 72 are hung into the individual receivers 62. Work piece holders 74 are connected to the lower ends of the intermediate carriers 74 via bayonet joints 73. Outer anode segments 75 are arranged in an outer ring and inner anode segments 76 in an inner ring at equal spacings from the circular path of the work piece holders. The outer anode segments 75 are fastened via insulating spacers 77 to the outer wall of the electroplating tank 50, while the inner anode segments 76 are suspended from angle beams 78. The angle beams 78 are fastened to a circular plate 79 which is mounted to the inner cover 58 via insulating spacers 80.

For protecting the electrolyte 51, dry inert gas 82 is admitted to the electroplating tank 50 via a feed line 81 opening into the cover 56. For pressure relief of the electroplating tank 50, the excess inert gas 82 is discharged via an opening 83 of the outer cover 56, a reflux cooler 84 and a relief line 85. Solvent vapors which rise from the electrolyte and are carried along with the inert gas are condensed at the cooling coil 87 of the reflux cooler 84, through which a coolant 86 flows, and flow back into the treatment tank 50.

The flap 57, which is operated via a linkage 88 and a lever, not shown in the drawing, forms the lower closure of a lock chamber 89. The upper closure of the lock chamber 89 is formed by a lock cover 90, through which a coupling rod 91 is brought. For sealing the feedthrough, a stuffing gland 92 is provided. The upper end of the coupling rod 91, which is movable in the vertical direction, forms a handle 93 and the lower end, a coupling sleeve 94, with which coupling pins 95 of the intermediate carriers 72 are associated. The coupling sleeve 94, together with a coupling pin 95, forms a bayonet joint which can readily be opened or closed by rotating the coupling rod 91. In order that a reliable insertion and removal of the work piece holders is assured, the motor 66 must be of such design that each support arm 61 can be separately selected and brought into a position where the conical opening of the associated receiver 62 is exactly aligned with the coupling rod 91. The transfer to the contact making and holding device 59 and the re-insertion of a work piece holder 10 can be observed, if desired, through a window not shown in detail. Cover 96 closes off a laterally arranged installation and servicing opening 97 of the lock chamber 89. The work piece holders 74 are inserted and removed via the cover 90, since then the inert gas contained in the lock chamber 89 cannot flow out. Mixing of the inert gas with air is reduced considerably thereby and, thus, the useful life of the electrolyte 51 is additionally increased.

An inert gas flooding system is provided for flooding the lock chamber 89 with an inert gas 98. This inert gas flooding system consists of a nozzle assembly 99 which is connected to a feed line 100 brought through the wall of the lock chamber 89, and of a relief line 101, which opens into the lock cover 90. In addition, a spraying system for spraying a rinsing liquid 102 is arranged in the lock chamber 89. The spraying system consists of a feed line 103, which is brought through the wall of the lock chamber 89 and is connected to a nozzle section 104, and of a discharge line 105.

We claim:

1. Apparatus for electrodepositing aluminum from an aprotic, oxygen-free and water-free organo-aluminum electrolyte comprising:

a. an electroplating tank containing the electrolyte having means for closing it off in an airtight manner;

b. means to supply an inert gas to said tank;

c. a contact making and holding device disposed within the electroplating tank and adapted for horizontal or rotatable movement of a work piece holder;

d. a lock chamber disposed above the electroplating tank having a closable lock opening for inserting and removing work pieces to be electroplated;

e. a closable flap coupling said tank and said chamber;

f. an inert gas flooding system for flooding said chamber;

g. a coupling rod arranged in the lock chamber and supported for vertical motion into and out of said electroplating tank for receiving a work piece holder, transferring said holder to the contact making and holding device and reinserting said work piece holder.

2. Apparatus according to claim 1 and further including a reflux cooler disposed in the upper region of said electroplating tank.

3. Apparatus according to claim 2 and further including a relief line having one end immersed in an inert sealing liquid with its other end connected to the electroplating tank through said reflux cooler.

4. Apparatus according to claim 1 wherein said contact-making and holding device is disposed so as to be horizontally movable.

5. Apparatus according to claim 4 and further including a spraying system for spraying a rinsing liquid disposed in said lock chamber.

6. Apparatus according to claim 5 and further including a reflux cooler disposed in the upper region of said electroplating tank.

7. Apparatus according to claim 6 and further including a relief line having one end immersed in an inert sealing liquid with its other end connected to the electroplating tank through said reflux cooler.

8. Apparatus according to claim 1 wherein said contact making and holding device comprises a rotatable contact making and holding device having at least two support arms for holding work piece holders.

9. Apparatus according to claim 8 and further including a spraying system for spraying a rinsing liquid disposed in said lock chamber.

10. Apparatus according to claim 9 and further including a reflux cooler disposed in the upper region of said electroplating tank.

11. Apparatus according to claim 10 and further including a relief line having one end immersed in an inert sealing liquid with its other end connected to the electroplating tank through said reflux cooler.

12. Apparatus according to claim 1 and further including a spraying system for spraying a rinsing liquid.

* * * * *